US011084277B1

(12) United States Patent
Cook

(10) Patent No.: US 11,084,277 B1
(45) Date of Patent: Aug. 10, 2021

(54) APPAREL STRAIGHTENER FOR HEAT TRANSFER PRINTING

(71) Applicant: Randall W. Cook, South Lyon, MI (US)

(72) Inventor: Randall W. Cook, South Lyon, MI (US)

( * ) Notice: Subject to any disclaimer, the term of this patent is extended or adjusted under 35 U.S.C. 154(b) by 175 days.

(21) Appl. No.: 16/502,247

(22) Filed: Jul. 3, 2019

Related U.S. Application Data

(60) Provisional application No. 62/693,820, filed on Jul. 3, 2018.

(51) Int. Cl.
*B41F 15/18* (2006.01)
*B41F 16/02* (2006.01)

(52) U.S. Cl.
CPC ..... *B41F 15/18* (2013.01); *B41F 16/02* (2013.01)

(58) Field of Classification Search
CPC ..... B41F 15/18; B41F 16/02
See application file for complete search history.

(56) References Cited

U.S. PATENT DOCUMENTS 4,201,132 A 5/1980 ZimmerHans
4,846,058 A * 7/1989 Farris ..... B41F 15/0813 101/123
4,860,467 A 8/1989 Larson
5,090,313 A 2/1992 Chapman
5,199,353 A * 4/1993 Szyszko ..... B41F 17/005 101/126
5,390,596 A 2/1995 Farr
5,581,918 A 12/1996 SchillingMax
6,112,657 A 9/2000 Bill
6,505,553 B2 1/2003 Ishida et al.
7,503,255 B2 3/2009 Weber
9,096,054 B2 8/2015 Moncavage
2007/0089618 A1* 4/2007 Robinson ..... B41F 16/02 100/233
2009/0293743 A1* 12/2009 Kim ..... B41L 19/00 101/41
2015/0360460 A1* 12/2015 Livingston ..... B41F 15/18 101/126
2016/0207301 A1* 7/2016 Szyszko ..... B41F 15/18
2016/0250863 A1* 9/2016 Livingston ..... B41J 3/4078 347/110
2018/0072044 A1* 3/2018 Livingston ..... D06F 71/40
2018/0147858 A1* 5/2018 Kunioka ..... D06P 5/00
2018/0222220 A1* 8/2018 Snir ..... B41J 3/4078
2018/0313033 A1* 11/2018 Yanase ..... B41F 15/12

FOREIGN PATENT DOCUMENTS

DE 4220160 A1 * 12/1993 ..... B41F 17/005
WO WO-0049216 A1 * 8/2000 ..... D06B 11/0073

* cited by examiner

*Primary Examiner* — Nguyen Q. Ha
(74) *Attorney, Agent, or Firm* — Cramer Patent & Design, PLLC; Aaron R. Cramer

(57) ABSTRACT

An apparel straightener for screen printing comprises a curvilinear unit of plexiglass or similar material having a plurality of fastening apertures and covered edge configured to removably secure to a screen-printing press.

17 Claims, 4 Drawing Sheets

APPAREL STRAIGHTENER FOR HEAT TRANSFER PRINTING

RELATED APPLICATIONS

The present invention is a continuation of, was first described in, and claims the benefit of U.S. Provisional Application No. 62/693,820 filed Jul. 3, 2018, the entire disclosures of which are incorporated herein by reference.

FIELD OF THE INVENTION

The presently disclosed subject matter is directed to an apparel straightener for heat transfer printing.

BACKGROUND OF THE INVENTION

In order to properly prepare apparel, such as shirts, for heat transfer printing, the apparel needs to be placed on a platform. The press with the desired design is then manipulated downward and pressed directly onto the apparel. When performing this process, the apparel needs to be properly positioned such that the desired design on the press is applied to the desired location on the apparel. Often times, the material of the apparel bunches up or is wrinkled and the user needs to identify this prior to pressing the design on the apparel and avoid incomplete printing or off-set printing. This bunching can occur prior to the press contacting the apparel or during contact.

Maintaining a perfectly positioned and straightened article of apparel on the press platform while also manipulating the press downward is a time-consuming process, especially when there is no other aid to help with either side of the process. Therefore, it is a convenient benefit and need for such a tool to aid in the heat transfer printing process as this invention provides. Shirts can be slid on and off the device quickly and with the assurance that the proper location of the area of the shirt to be afforded the heat transfer printing is properly aligned with the press.

SUMMARY OF THE INVENTION

The principles of the present invention provide for an apparel straightening aid comprising a bracket removably and adjustably affixed to a press bottom platform, a straightener device positioned within a gap between the bracket and the press bottom platform and secured therein, and a rail located at a perimeter edge of a first end of the straightener device. The rail has a rail top portion and a rail bottom portion. The rail top portion may be attached to the straightener device such that the rail bottom portion depends below the first end of the straightener device. The apparel straightening aid also comprises a pair of wing portions which are located at opposing sides of a first end of the straightener device and a neck portion located at a center position on a second end of the straightener device and a plurality of device apertures equidistantly spaced and adjacent to a perimeter edge of the straightener device.

The apparel straightening aid may also comprise an upper surface coextensive with an upper surface of the press bottom platform when the apparel straightening aid is properly positioned. The rail bottom portion may have a thickness capable of filling the gap of the bracket. The rail bottom portion may fully support the straightener device in a planar configuration which is coextensive with the upper surfaces of both the straightener device and the press bottom platform.

The rail may be attached to the apparel straightening aid with adhesive. The rail may be made of plastic or metal and may be L-shaped. The pair of wing portions are as wide as the screen press bottom platform. The apparel straightening aid may properly align and flatten an article of clothing on the press bottom platform for subsequent use of a heat transfer printing process. The apparel straightening aid may properly align and flatten an article of clothing on the press bottom platform for subsequent use of a heat transfer printing process. The apparel straightening aid may be made of a single piece of opaque plastic or transparent plastic. The apparel straightening aid may be made of resilient material. The apparel straightening aid may be made of material selected from the group consisting of acrylic, stainless steel, or aluminum. The bracket may be made of plastic or metal.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
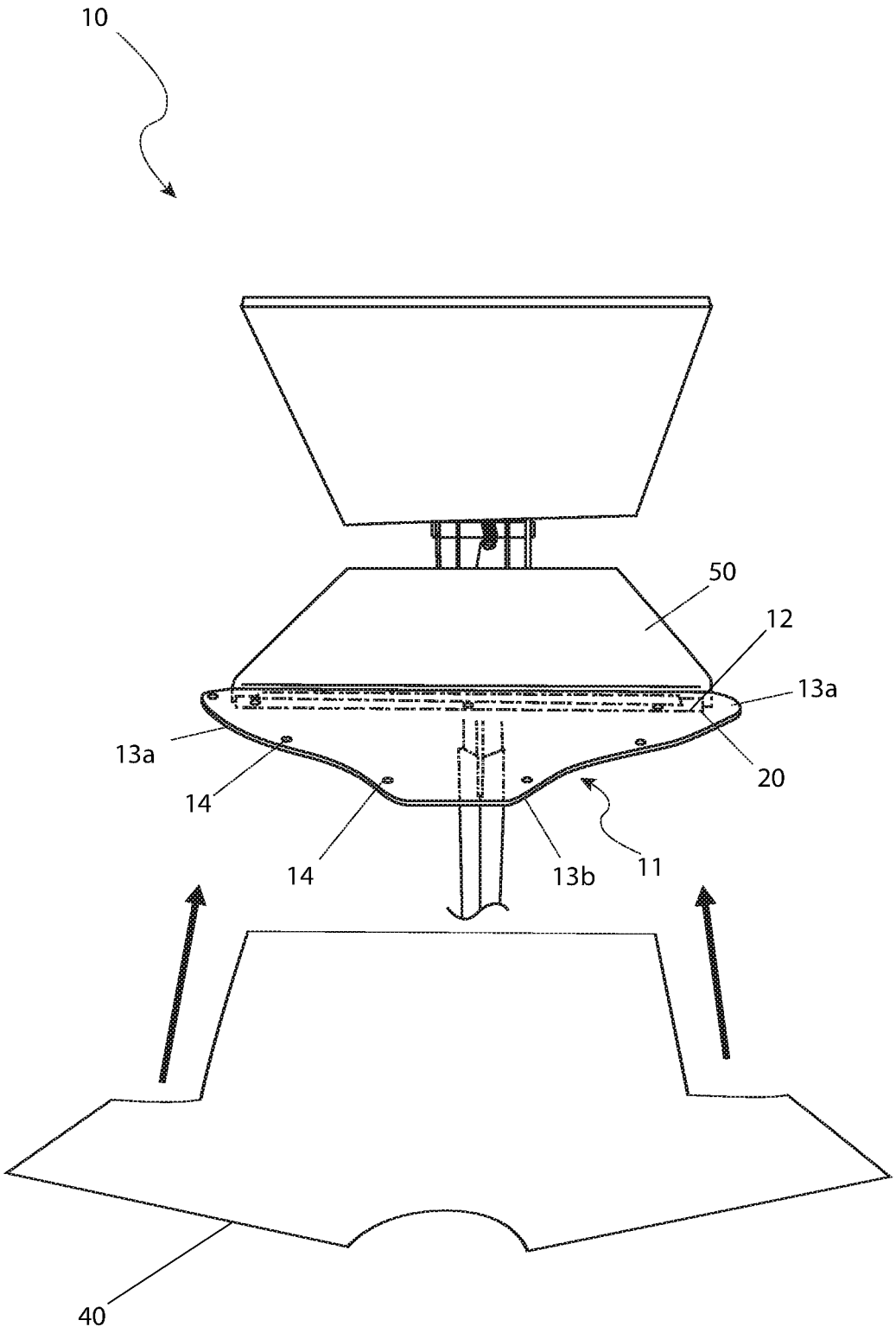
FIG. 1 is a front perspective view of the apparel straightening aid 10, comprising a straightener device 11 attached to a bracket 20 of the press bottom platform 50, according to the preferred embodiment of the present invention.

10 apparel straightening aid
11 straightener device
12 rail
13*a* wing portion
13*b* neck portion
14 device aperture
15 gap
20 bracket
21 bracket aperture
22 fastener
24 bracket bottom
25 bracket lip
26 bracket side
30*a* rail top portion
30*b* rail bottom portion
40 article of clothing
50 press bottom platform

DESCRIPTION OF THE INVENTION

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Referring now to FIG. 1, which illustrates a front perspective view of the apparel straightening aid (herein described as the "system" 10), which includes a bracket 20 removably and adjustably affixed to a press bottom platform 50, and a straightener device (herein described as the "device") 11 which is positioned within a gap 15 between the bracket 20 and press bottom platform 50 and secured therein. When properly positioned, the device 11 has an upper surface coextensive with an upper surface of the press bottom platform 50. The device 10 properly aligns and flattens an article of clothing 40 on the press bottom platform 50 for subsequent use of the heat transfer printing process. The rail 12 and bracket 20 may preferably be a plastic or metallic material of construction and the device 11 may be an opaque or transparent plastic material.

Figure 3:
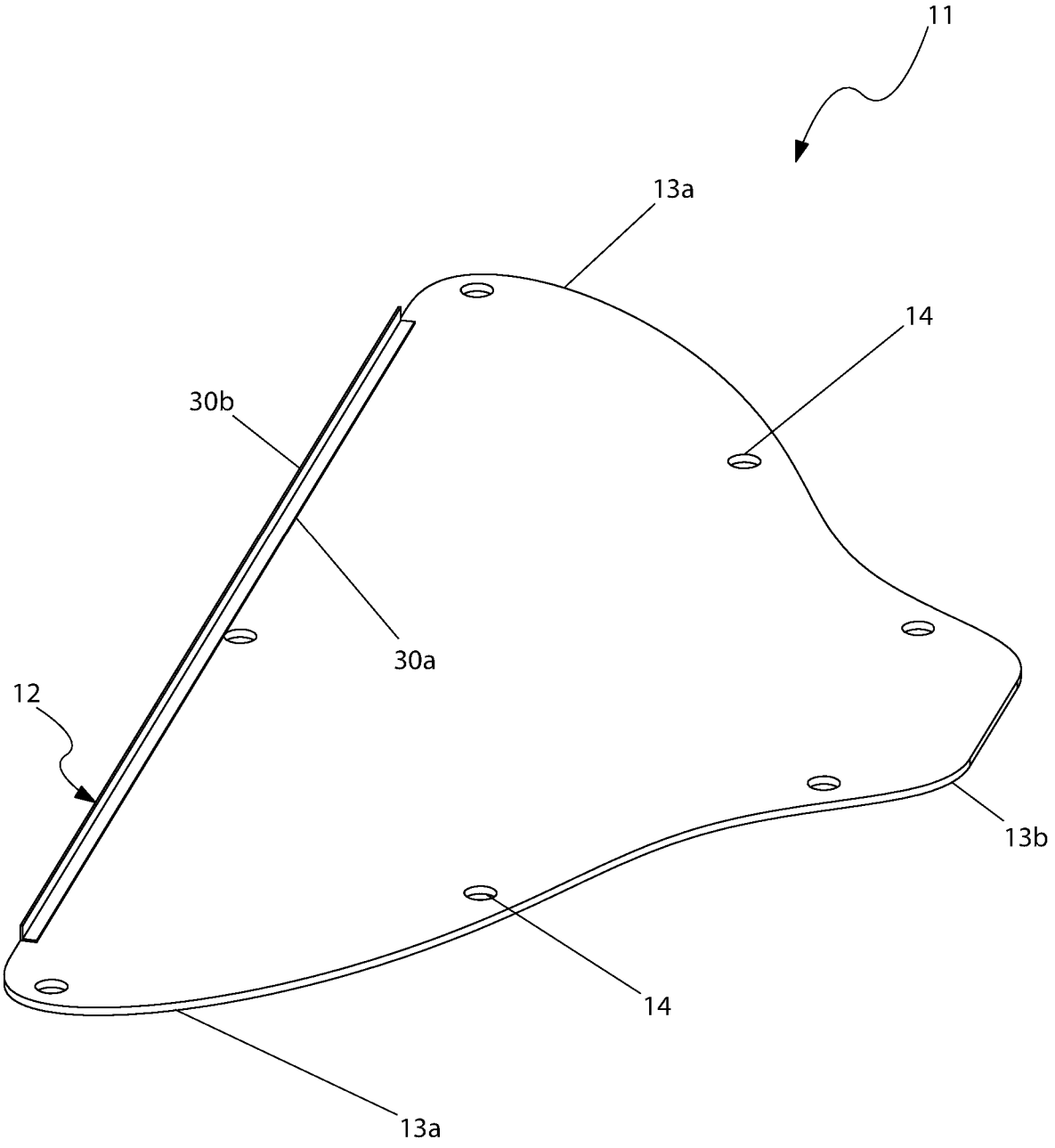
FIG. 3 is a bottom view of the straightener device 11, according to a preferred embodiment of the present invention; and, FIG. 4 is a top perspective view of the bracket 20, according to a preferred embodiment of the present invention.

Referring now more closely to FIG. 3, the device 11 is generally planar and symmetrical, having a pair of wing portions 13*a* located at opposing sides of a first end of the device 11 and a neck portion 13*b* located at a center position on a second end. The first end is linear. The pair of wing portions 13*a* are typically as wide as, or slightly greater than, the width of the screen press bottom platform 50. A plurality of device apertures 14 are preferably equidistantly spaced and adjacent to a perimeter edge of the device 11, say for the first end.

Located on a lower side of the device 11 is a rail 12 that is generally "L"-shaped and can have a width either coextensive with or slightly less that the width of the first end of the device 11. The rail 12 is located at the perimeter edge of the first end of the device 11. The rail 12 is described as having a rail top portion 30*a* and a rail bottom portion 30*b*. The rail top portion 30*a* is attached to the device 11 such that the rail bottom portion 30*b* depends below the first end of the device 11. The rail bottom portion 30*b* has a thickness capable of filling the gap 15 of the bracket 20 (see FIG. 4), yet still fully support the device 11 in a planar configuration coextensive with the upper surfaces of both the device 11 and the press bottom platform 50. The device 11 can be manufactured out of a single piece of material and resilient, such as acrylic, stainless steel, aluminum, or the like. The rail 12 can be attached with fasteners of adhesively bonded to the device 11.

Figure 4:
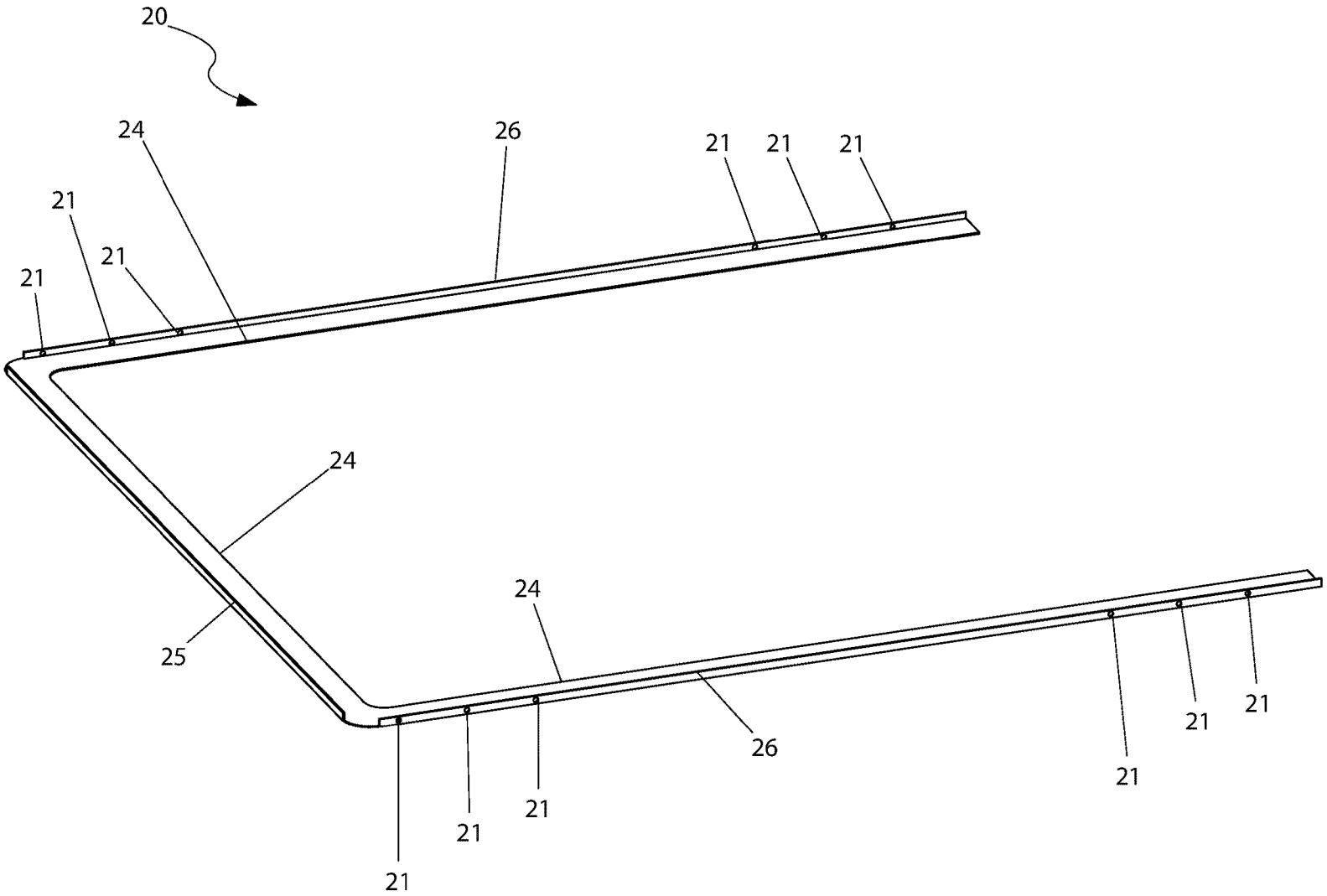

FIG. 4 illustrates a top perspective view of the bracket 20. The bracket 20 is essentially a "U"-shaped structure having a bracket lip 25 with a pair of bracket sides 26. The bracket 20 is attached about the perimeter sides and front of the press bottom platform 50. Both bracket sides 26 are generally "L"-shaped and have a bracket bottom portion 24 cradling the bottom surface of the press bottom platform 50. A front end of the bracket sides 26 have a plurality of bracket apertures 21 equidistantly spaced, each capable of receiving a fastener 22 therethrough to fasten the bracket 20 to the press bottom platform 50 (although only one (1) side is illustrated herein). Also, the rear end of the bracket sides 26 also have a plurality of bracket apertures 21 equidistantly spaced and perform the same function. The bracket lip 25 is generally "L"-shaped and similarly shaped as the bracket sides 26, and extend to the extent vertically as the bracket sides 26 do. There are cutouts at the corners of the bracket 20 to delineate the transition between the bracket sides 26 and bracket lip 25. The bracket 20 is attached to a position on the press bottom platform 20 at such a position so the gap 15 between the front facing side of the press bottom platform 50 and the bracket lip 25 can accommodate the rail bottom portion 30*b* of the rail 12 of the device 11.

Figure 2:
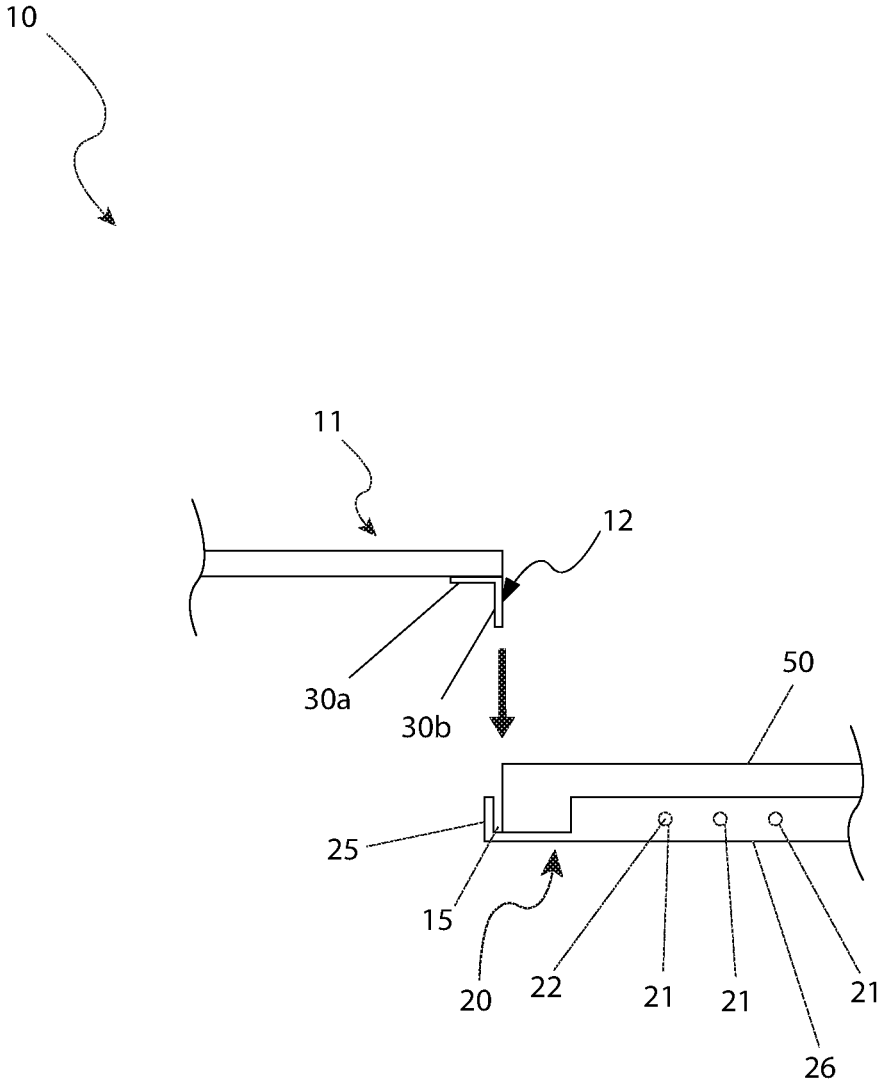
FIG. 2 is a close-up side view of the straightener device 11 detached from the bracket 20, according to the preferred embodiment of the present invention.

FIG. 2 illustrates a close-up of the engagement between the rail 12 of the device 11 and the gap 15 of the bracket 20. In use, the rail bottom portion 30*a* of the rail 12 of the device 11 is inserted in the gap 15 of the bracket lip 25 when the bracket sides 26 are fastened to the press bottom platform 50. An article of clothing 40 that is to be afforded a heat transfer printing process, which is typically a shirt, is slid on the device 11, preferably so the neck portion 13*b* of the device 11 is inserted into the neck hole of the article of clothing 40, and the wing portions 13*a* of the device 10 extend to within and possibly through the arm holes of the article of clothing 40 and to ensure that the remainder of the article of clothing 40 resides on the press bottom platform 50 and the side of the article of clothing 40 is facing upward and in alignment with the heat transfer press. This effectively straightens the article of clothing 40 prior to the heat transfer printing process.

The foregoing descriptions of specific embodiments of the present invention have been presented for purposes of illustration and description. They are not intended to be exhaustive or to limit the invention to the precise forms disclosed, and obviously many modifications and variations are possible considering the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. An apparel straightening aid, comprising:

a bracket removably and adjustably affixed to a press bottom platform;

a straightener device positioned within a gap between the bracket and the press bottom platform and secured therein;

a rail located at a perimeter edge of a first end of the straightener device, the rail having a rail top portion and a rail bottom portion, the rail top portion is attached to the straightener device such that the rail bottom portion depends below the first end of the straightener device;

a pair of wing portions located at opposing sides of a first end of the straightener device and a neck portion located at a center position on a second end of the straightener device; and, a plurality of device apertures equidistantly spaced and adjacent to a perimeter edge of the straightener device.

2. The apparel straightening aid according to claim 1, wherein the straightener device having an upper surface coextensive with an upper surface of the press bottom platform when the wherein the straightener device is properly positioned.

3. The apparel straightening aid according to claim 1, wherein the rail bottom portion having a thickness capable of filling the gap between the bracket and the press bottom platform.

4. The apparel straightening aid according to claim 1, wherein the rail bottom portion fully supports the straightener device in a planar configuration coextensive with the upper surfaces of both the straightener device and the press bottom platform.

5. The apparel straightening aid according to claim 1, wherein the rail is attached to the straightener device with adhesive.

6. The apparel straightening aid according to claim 1, wherein the rail is made of plastic.

7. The apparel straightening aid according to claim 1, wherein the rail is made of metal.

8. The apparel straightening aid according to claim 1, wherein the rail is L-shaped.

9. The apparel straightening aid according to claim 1, wherein the pair of wing portions are as wide as the press bottom platform.

10. The apparel straightening aid according to claim 1, wherein the apparel straightening aid properly aligns and flattens an article of clothing on the press bottom platform for subsequent use of a heat transfer printing process.

11. The apparel straightening aid according to claim 1, wherein the straightener device is made of opaque plastic.

12. The apparel straightening aid according to claim 1, wherein the straightener device is made of transparent plastic.

13. The apparel straightening aid according to claim 1, wherein the straightener device aid is made of a single piece.

14. The apparel straightening aid according to claim 1, wherein the straightener device is made of resilient material.

15. The apparel straightening aid according to claim 1, wherein the straightener device is made of material selected from the group consisting of acrylic, stainless steel, or aluminum.

16. The apparel straightening aid according to claim 1, wherein the bracket is made of plastic.

17. The apparel straightening aid according to claim 1, wherein the bracket is made of metal.

* * * * *